US006606461B2

(12) United States Patent
Ochiai

(10) Patent No.: US 6,606,461 B2
(45) Date of Patent: Aug. 12, 2003

(54) CONTROL MECHANISM AND METHOD FOR CONTROLLING ROTATION OF A PHOTOSENSITIVE DRUM IN AN IMAGE FORMING APPARATUS WHEN A COVER MEMBER OF THE IMAGE FORMING APPARATUS IS OPENED

(75) Inventor: Norikazu Ochiai, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/951,879

(22) Filed: Sep. 13, 2001

(65) Prior Publication Data

US 2003/0049035 A1 Mar. 13, 2003

(51) Int. Cl.[7] ..... G03G 15/00; G03G 21/00

(52) U.S. Cl. ..... 399/18; 399/98; 399/121; 399/124

(58) Field of Search ..... 399/18, 124, 125, 399/121, 98, 101

(56) References Cited

U.S. PATENT DOCUMENTS 4,260,236 A * 4/1981 Tsuda et al. ..... 399/18
5,132,738 A 7/1992 Nakamura et al.
5,897,244 A * 4/1999 Miyazaki et al. ..... 399/122

FOREIGN PATENT DOCUMENTS

JP 03-248181 A 11/1991
JP 09244321 A * 9/1997

* cited by examiner

*Primary Examiner*—Joan Pendegrass
(74) *Attorney, Agent, or Firm*—Frishauf, Holtz, Goodman & Chick, P.C.

(57) ABSTRACT

The image forming apparatus of the present invention includes a main body of the apparatus which has an opening section, a cover which covers/uncovers the opening section of the main body of the apparatus, a photosensitive member provided in the main body of the apparatus, a developer provided for forming a toner image sticking toner on the photosensitive member at a developing position in the main body of the apparatus, a transfer roller provided in the main body of the apparatus, and a control mechanism provided in the main body of the apparatus, for rotating the photosensitive member by a distance larger than a distance between the developing position and the transcribing position during the cover is moved from the first position to the second position and then moved from the second position to the first position.

6 Claims, 4 Drawing Sheets

CONTROL MECHANISM AND METHOD FOR CONTROLLING ROTATION OF A PHOTOSENSITIVE DRUM IN AN IMAGE FORMING APPARATUS WHEN A COVER MEMBER OF THE IMAGE FORMING APPARATUS IS OPENED

BACKGROUND OF THE INVENTION

The present invention relates to an image forming apparatus, applied to a method of electrophotography used in a printer, etc.

The image forming apparatus, applied to a method of electrophotography, develops a toner image on a surface of a photosensitive member by applying toner from a developer, and then transfers the toner image onto a recording paper by a transfer device. There is a transfer roller for the transfer device, the transfer roller charges a voltage which is an inverse electric potential, as a transcription potential, onto a recording paper which is being conveyed between the photosensitive member and the transfer roller.

When jamming of recording paper has occurred in a recording paper conveying path, the jammed paper is removed from the conveying path by disengaging the transfer roller from the photosensitive member in the image forming apparatus which is equipped with the transfer roller. Thus, such an image forming apparatus consists of the following structure. Providing an opening section in the main body of the apparatus facing the photosensitive member, to which a cover is attached to cover/uncover the opening section. A transfer roller is attached to the inner surface of the cover. In normal operation, the opening section of the main body is covered by the cover, and the transfer roller is set in contact with the photosensitive member. While maintaining this condition, the toner, sticking on the photosensitive member, is transferred to the recording paper. When a jam of the recording paper has occurred, the cover is disengaged from the opening section of the main body, uncovering the opening section, and disengaging the transfer roller from the photosensitive member. Then, the paper, stuck in the paper conveying path, is taken out through the opening section to the outside of the main body of the apparatus. After removing the recording paper, the opening section of the main body is covered again by the cover, and the transfer roller is brought back into contact with the photosensitive member.

As the photosensitive member carries the toner stuck by the developer to the position facing the transfer roller, toner is stuck on the area of the surface of the photosensitive member from the position facing the developer, to the position facing the transfer roller. Therefore, when covering the opening section of the main body by the cover again, and the photosensitive member is rotated, moving the area of the surface of the photosensitive member where the toner is stuck, the toner sticks onto the area of the transfer roller which has been in contact with the photosensitive member. If the toner is thus carried on the transfer roller, the surface of the paper is stained with the toner, causing the toner to be undesirably transferred onto the recording paper.

As a solution to the above-described drawback, shown in Jpn. Pat. Appln. KOKAI Publication No. 3-248181 and U.S. Pat. No. 5,132,738, the technique of removing toner is known, by charging a voltage of a potential which is opposed to an electric potential of transcribing voltage, thus the toner, which is stuck on the transfer roller is returned to the photosensitive member.

In some cases, surplus toner is supplied to the area of the surface of the photosensitive member between the position of the developer and the position of the transfer roller, therefore some of the toner is stuck to the transfer roller. In this case, even if the transfer roller is charged with the voltage of an inverse potential to that of the transfer voltage, it is difficult to sufficiently remove the surplus toner from the transfer roller. The toner to be applied by the developer to the surface of the photosensitive member has a preset potential; however in some cases, some of the toner has a inverted potential to the preset potential. The toner of the inverted potential cannot be removed even if the transfer roller is charged with a voltage of the potential inversed to the transcriptional potential, and it is necessary to remove the toner of the inverted potential charging the transfer roller with a voltage of the same potential as the transcribing potential.

Hence, the voltage control is complicated with the necessity to charge alternately the transfer roller, between the voltage of the normal potential equal to the transcribing potential and the inverted voltage of an inverted potential in order to remove the toner from the transfer roller. Further, the time needed for removing the toner from the transfer roller is increased, because the voltage is charged to the transfer roller during rotating (this rotation is not used for the transcribing) the transfer roller, in order to remove the toner from the transfer roller.

BRIEF SUMMARY OF THE INVENTION

The present invention supplies an image forming apparatus capable of surely and quickly preventing toner sticking on the transfer roller from the photosensitive member by economical techniques.

Moreover, according to the present invention, the apparatus avoids toner being stuck to the transfer roller from the photosensitive member, by moving the area with the toner stuck on the surface of the photosensitive member, from the position in contact with the transfer roller, rotating the photosensitive member, while the transfer roller is disengaged from the photosensitive member when the cover is opened.

An image forming apparatus of the present invention comprising: a main body of the apparatus having an opening section; a cover attached to the main body of the apparatus, this cover alternates between a first position where the opening section is covered and a second position where the opening section is uncovered as disengaged from the opening section; a photosensitive member equipped to be rotated in the main body of the apparatus to face the opening; a developer equipped in the main body of the apparatus, this developer forms a toner image, sticking the toner on the photosensitive member at a developing position; a transfer roller equipped in the main body of the apparatus, this transfer roller, attached to an inner surface of the cover facing the photosensitive member, transcribes the toner image of the photosensitive member to recording paper at a transcribing position on a downstream side from the developing position, in a rotating direction of the photosensitive member; and a control mechanism equipped in the main body of the apparatus, this control mechanism rotates the photosensitive member by a distance larger than a distance between the developing position and the transcribing position, during the time the cover is alternated from the first position to the second position and then alternated from the second position to the first position.

A controlling method of an photosensitive member for an image forming apparatus of the present invention comprising: providing a main body of the apparatus, having an opening section; providing a cover, alternated between a first position where the opening section is covered and a second position where the opening section is uncovered, disengaging from the opening section in the main body of the apparatus; providing a photosensitive member in the main body of the apparatus facing to the opening section; providing a developer in the main body of the apparatus, forming a toner image on the photosensitive member at a developing position for sticking toner; providing a transfer roller in the main body of the apparatus, attaching on an inner surface of the cover facing the photosensitive member, transferring the toner image of the photosensitive member to recording paper at a transcribing position on a downstream side from the developing position along a rotating direction of the photosensitive member; and providing a control mechanism in the main body of the apparatus, for rotating the photosensitive member by a distance larger than a distance between the developing position and the transcribing position during the time the cover is alternated from the first position to the second position and then alternated from the second position to the first position.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described with reference to FIGS. 1 to 4.

Figure 1:
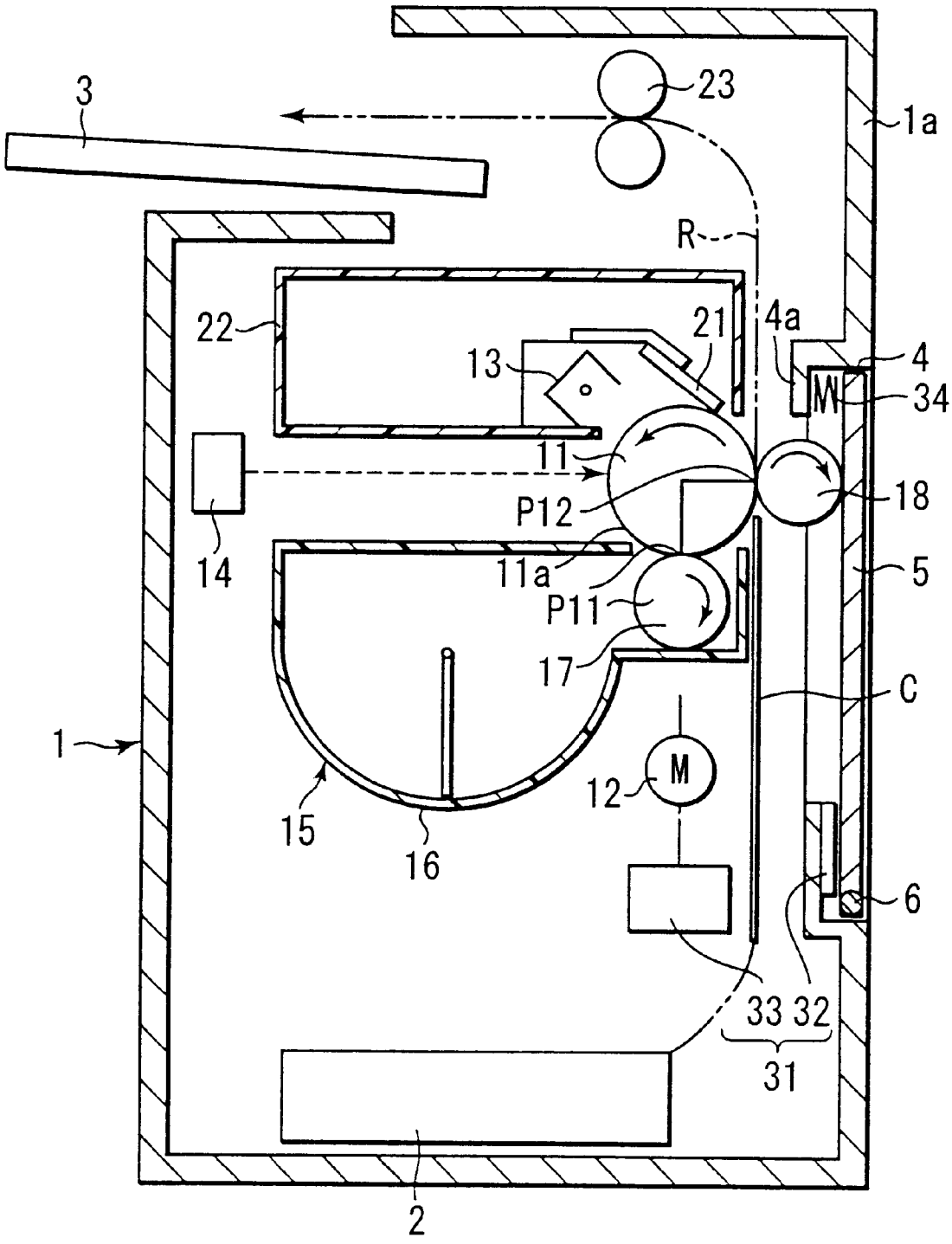
FIG. 1 is a cross-section view showing schematically an image forming apparatus according to an embodiment of the present invention.
Figure 2:
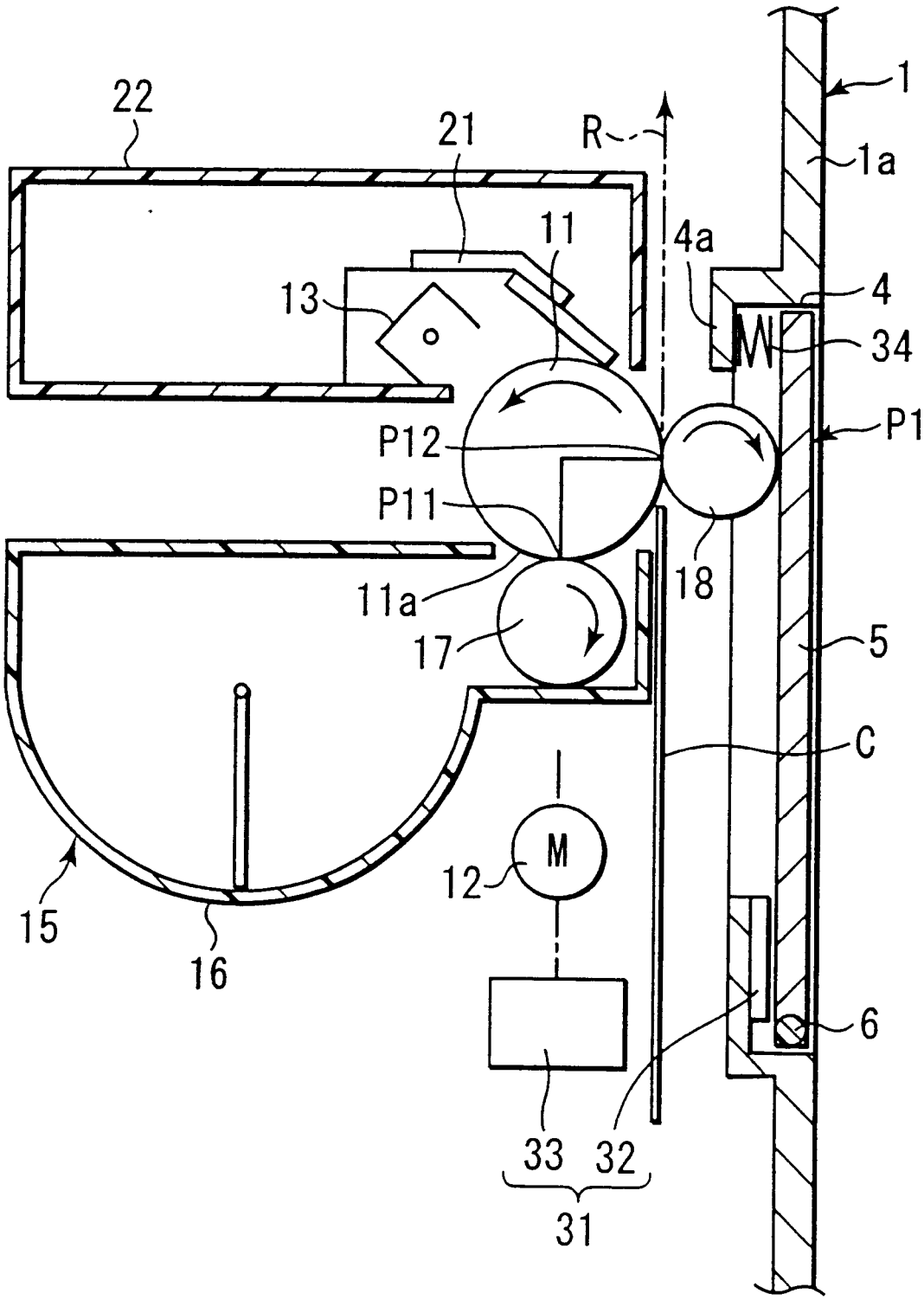
FIG. 2 is an enlarged cross-section view showing schematically a photosensitive member, a transfer roller and a cover in the image forming apparatus according to the embodiment.
Figure 3:
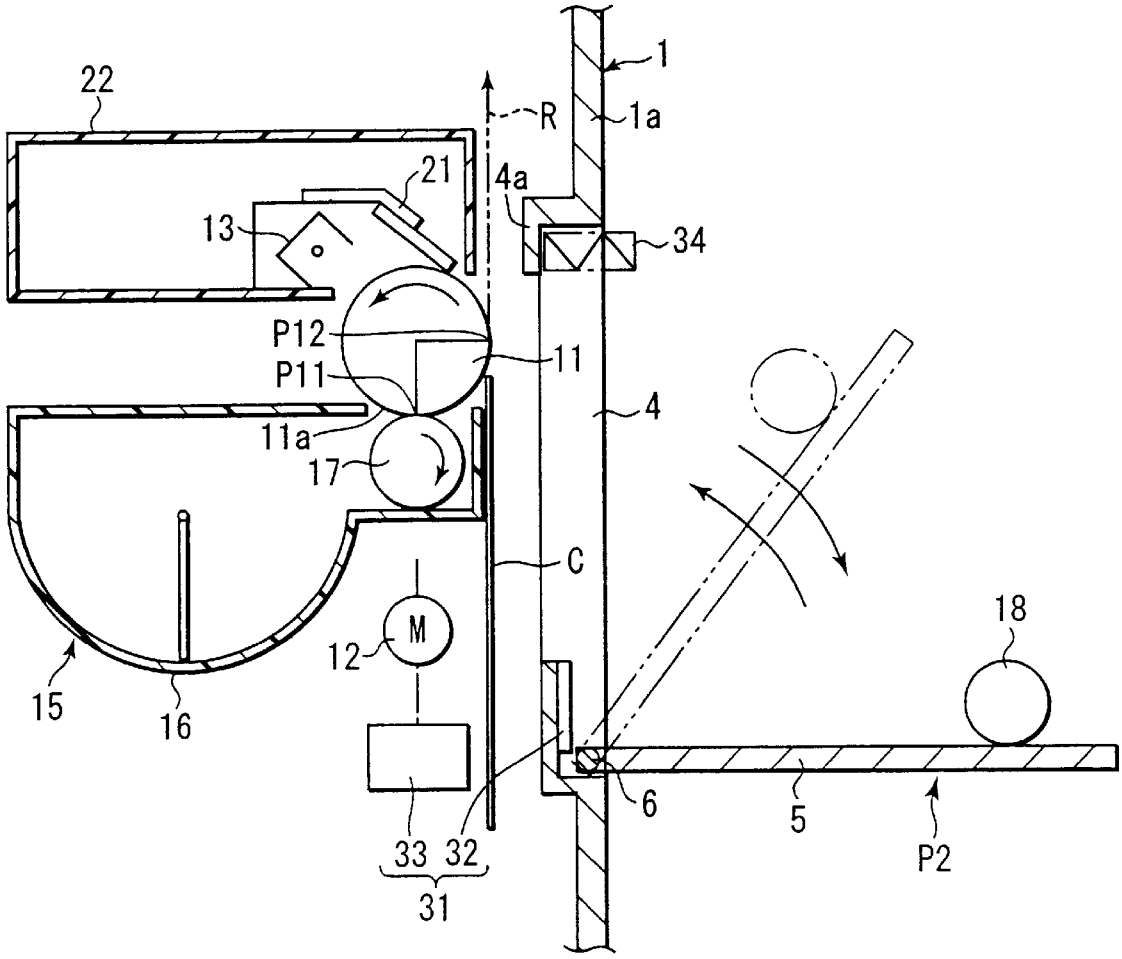
FIG. 3 is an enlarged cross-section view showing schematically a photosensitive member, a transfer roller and a cover in the image forming apparatus according to the embodiment.

FIG. 1 is a cross-section view showing schematically an image forming apparatus according to an embodiment of the present invention. The image forming apparatus is used as, for an example, a printer.

There is a cassette 2 in a lower section of the main body 1 of the image forming apparatus, for storing recording paper laid flat, and a tray 3 for receiving recording paper on which an image is recorded, is placed in an upper section. A recording paper path R, provided in the main body 1 of the apparatus, is for recording an image on recording paper C, conveying it upwards along the vertical direction from the cassette 2 toward the tray 3. The recording paper path R is provided close to a wall portion 1*a* formed along the vertical direction of the main body 1 of the apparatus, and an opening section 4, formed in a quadranglar shape, is made in the wall portion 1*a* facing the recording paper path R.

A cover 5 for covering/uncovering the opening section 4 is attached to the wall portion 1*a* of the main body 1 of the apparatus. The opening section 4 has a step portion 4*a* around its edge section, which is situated inside the main body 1 of the apparatus. This step portion 4*a* is for receiving stably the cover 5. The cover 5 is formed of a quadrangular shape, the size of which is able to cover the opening section 4, and is supported by a fulcrum shaft 6 at the lower end portion of itself placing to cover the opening section 4. Therefore, the cover 5 is rotated around the shaft 6 set at the lower end portion, between a first position P1 shown in FIG. 2 and a second position P2 shown in FIG. 3 located outside the main body 1 of the apparatus. The first position P1 is the position where the cover 5 is set in a standing position to cover the opening section 4 of the main body 1 of the apparatus. The second position P2 is the position where the cover 5 disengages from the first position P1 and falls outwards from the main body 1 of the apparatus to uncover the opening section 4.

Figure 4:
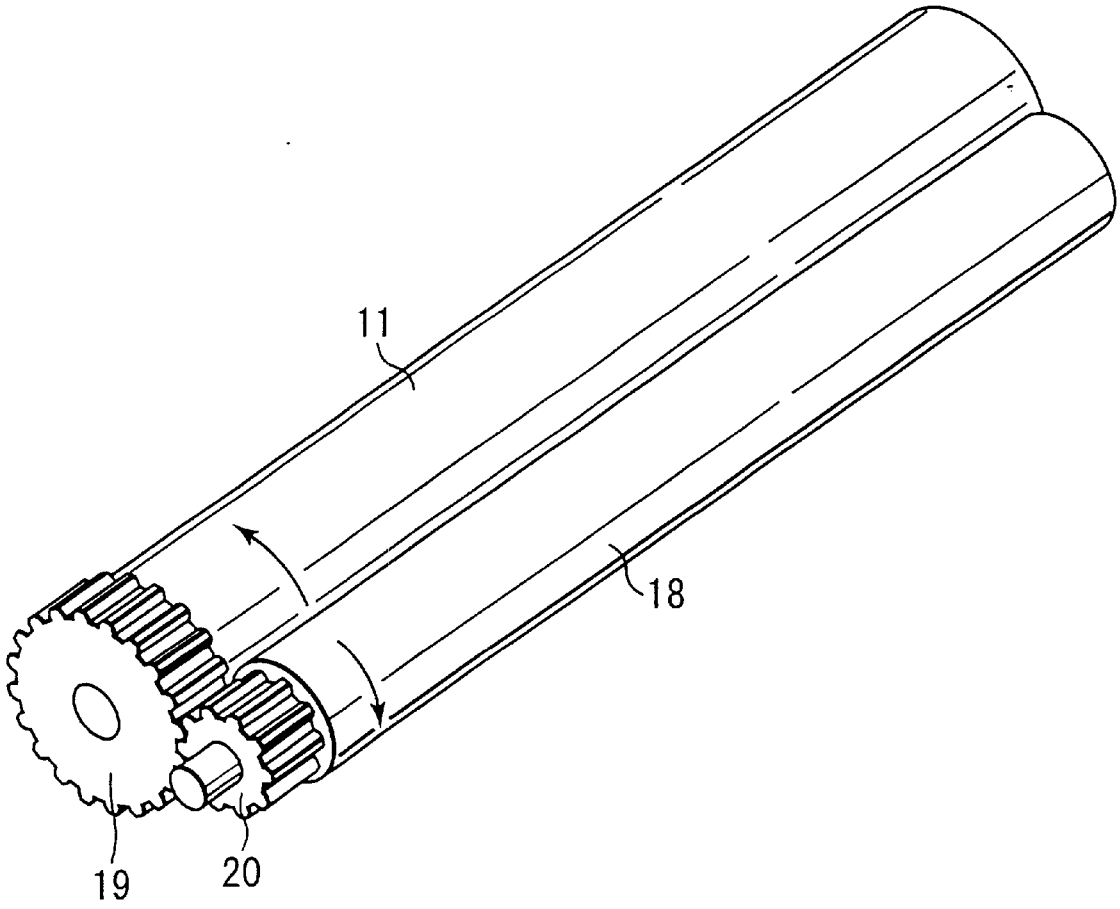
FIG. 4 is a perspective view showing the photosensitive member and the transfer roller in the image forming apparatus according to the embodiment.

There are mechanisms for performing image forming, provided in the main body 1 of the apparatus, interposing the recording paper path R. The photosensitive drum 11 is provided horizontally to be rotatable, facing the opening section 4 of the wall portion 1*a* of the main body 1 of the apparatus. A motor 12 for rotational driving of the photosensitive drum is provided inside the main body 1 of the apparatus. The rotation of the motor 12 is transmitted to the photosensitive drum 1 via a gear mechanism (not shown). As shown in FIG. 4, the photosensitive drum 11 has a gear 19 at one end portion, and is rotated along a direction shown by the arrow in the figure, via the gear 19 by the motor 12. The rotating direction is a forward direction in which the surface of the photosensitive drum 11 rotates in accordance with the process of image forming.

In an area of the side where the photosensitive drum 11 is provided facing the recording paper path R, a charger 13, an exposer 14 and a developer 15 are provided around the circumference of the photosensitive drum 11. The charger 13, exposer 14 and developer 15 are placed from the upstream side of the rotating direction to the downstream side in order.

The charger 13, placed above the photosensitive drum 11, charges a surface 11*a* (outer circumferential surface) of the photosensitive drum 11. The exposer 14, placed at the same height, for example, as the photosensitive drum 11, exposes the surface 11*a* of the photosensitive drum 11, and forms a static latent image.

The developer 15, placed below the photosensitive drum 11, includes a toner tank 16 and a developer roller 17. The toner tank 16 is for storing toner, and the developer roller 17, supplying toner from the toner tank 16 onto the surface 11*a* of the photosensitive drum 11, to form a toner image. The developer roller 17, placed just below the photosensitive drum 11 in parallel, is in contact with the surface 11*a* of the photosensitive drum 11. This contact position is a developing position P11, supplies toner to the surface 11*a* of the photosensitive drum 11.

A transfer roller 18 is provided in an area of the opposite side (the opening section 4 side of the main body 1 of the apparatus) to the area where the photosensitive drum 11 is provided, interposing the recording paper path R. The transfer roller 18 is placed horizontally on an inner surface of the cover 5 for covering/uncovering the opening section 4 of the main body 1 of the apparatus, and is rotatably supported. The transfer roller 18 is in contact with the surface 11*a* of the photosensitive drum 11, placed at the same level as the photosensitive drum 11 in parallel when the cover 5 exists at the first position P1 (when covering the opening section 5 of the main body 1 of the apparatus).

The transfer roller 18 charges a transcribing voltage to the recording paper C while conveying the recording paper C interposed between the transfer roller 18 and the photosensitive drum 11, and transcribes the toner image of the photosensitive drum 11 to the recording paper C. The position, where the surface of the transfer roller 18 is in contact with the surface 11*a* of the photosensitive drum 11, is a transfer position P12. The transfer position P12 is located on the downstream side from the developing position P11 along the rotating direction of the photosensitive drum 11.

As shown in FIG. 4, a gear 20 is assembled at one end portion of the transfer roller 18. When the cover 5 exists at the first position P1 and the transfer roller 18 is contact with the photosensitive drum 11, the gear 20 is engaged with the gear 19 of the photosensitive drum 11. The transfer roller 18 is rotated in the direction indicated by the arrow, as the rotation of the photosensitive drum 11 rotates, and conveys the recording paper C through the recording paper path R. When the cover 5 exists at the second position (uncovering the opening section 4 of the main body 1 of the apparatus) and the transfer roller 18 does not contact the photosensitive drum 11, the gear 20 is disengaged from the gear 19 of the photosensitive drum 11.

A cleaning blade 21 and a waste toner tank 22 are provided above the photosensitive drum 1. The cleaning blade 21 is in contact with the surface 11*a* of the photosensitive drum 11 at an area on the downstream side of the transfer position P12 along the rotating direction, and wipes off toner stuck on the surface 11*a*. The waste toner tank 22 is for collecting the toner wiped off by the cleaning blade 21. A fixing unit 23 is provided above the recording paper path R. The fixing unit 23 fixes the toner image transferred to the recording paper C. The recording paper C which has been fixed is discharged to a tray 3.

With the structure for forming an image, described in the above, in which a recording paper C is unloaded from the cassette 2, passing through between the photosensitive drum 11 and the transfer roller 18, as well as the fixing unit 23, an image is recorded, and then the recording paper C is discharged to the tray 3.

A control mechanism 31 is provided on the main body 1 of the apparatus. The control mechanism 31 rotates the photosensitive drum 11 along in a forward direction by a distance equal to or larger than the distance between the developing position P11 and the transcribing position P12, during the cover 5 is alternated from the first position P1 to the second position P2 and also alternated from the second position P2 to the first position P1 again. With this operation, the toner on the photosensitive drum 11 is prevented from sticking to the transfer roller 18.

The control mechanism 31 includes a sensor 32 and a control circuit 33. The sensor 32 has either one of or both of a function of detecting the opening motion of the cover 5 which existed at the first position P1 (covering the opening section 4 of the main body 1 of the apparatus) moving towards the second position P2 (uncovering the opening section 4 of the main body 1 of the apparatus), and a function of detecting the motion of the cover 5 which exists at the second position P2 moving towards the first position P1. The detection method and the location of the sensor 32 is determined in accordance with the number and type of function of the sensor.

For examples of the detection method of the sensor 32, there are an optical method and a mechanical method etc. According to the former method, which combines a light source with a photoelectric element for receiving a light beam emitted from the light source, the photoelectric element outputs a signal when the cover is inserted into the light beam passing between the light source and the photoelectric element, stopping the light reaching the photoelectric element. According to the mechanical method, combining a movement member moved by the cover with a switch which is turned on by the motion of the movement member, the switch outputs a detection signal, causing the movement member to be moved by the rotation of the cover.

The control circuit 33 controls the start and stop of the rotation of the motor 12 for driving to rotate the photosensitive drum. The control circuit 33 receives a detected signal outputted from the sensor 32, and controls the motor 12 to drive it. The details of the control are, rotating photosensitive drum 11 in a forward direction by a distance equal to or larger than the distance between the developing position P11 and the transcribing position P12 on the surface 11*a*. In other words, the photosensitive drum 11 is rotated by an angle equal to or larger than the angle made at the center of the photosensitive drum 11 between the developing position P11 and the transcribing position P12.

A case will be described in which the control mechanism 31, which is a combination of the sensor 32 and the control circuit 33, controls the rotation of the photosensitive drum 11.

Usually, the opening section 4 of the main body 11 of the apparatus is covered, with the cover 5 at the first position P1 when the image forming apparatus is used. For example, when a jam of recording paper C has occurred in the recording paper path R, the rotation of the photosensitive drum 11 and the transfer roller 18 stops. In this condition, toner supplied at the developing position P11 is sticking on the area between the developing position P11 and the transcribing position P12 on the surface 11*a* of the photosensitive drum 11.

When a jam of recording paper C has occurred in the recording paper path R, the opening section 4 of the main body 1 of the apparatus will be uncovered by the user, rotating the cover 5 from the first position P1 to the second position P2 where is the outside of the main body 1 of the apparatus. The transfer roller 18 is disengaged from the photosensitive drum 11, moving with the cover 5. The user takes out the recording paper C from the recording paper path R through the opening section 4 which has been uncovered. After that, the user covers the opening section 5 of the main body 1 of the apparatus, rotating the cover 5 from the second position P12 to the first position P1.

When the sensor 32 has the function to detect the opening motion of the cover 5, the sensor 32 detects the motion of the cover 5 on the way, during the cover 5 is rotating from the first position P1 to the second position P2 where is the outside of the main body 1 of the apparatus. The sensor 32 outputs a detected signal to the control circuit 33. For example, the sensor 32 detects the motion of the cover 5 as soon as the cover 5 has been disengaged from the first position P1. The control circuit 33, receiving the detected signal from the sensor 32, orders the motor 12 to drive, and rotates the photosensitive drum 11. The photosensitive drum 11 is rotated in the forward direction by a distance equal to or larger than the distance between the developing position P11 and the transcribing position P12 on the surface 11*a*.

When the sensor 32 detects the covering motion of the cover 5, the sensor 32 detects the motion of the cover 5 on the way while the cover is rotating from the second position P2 to the first position P1. The control circuit 33 receives the detected signal from the sensor 32, then rotates the photosensitive drum 11 ordering the motor 12 to drive. The photosensitive drum 11 is rotated similarly, in the forward direction by a distance equal to or larger than the distance between the developing position P11 and the transcribing position P12 on the surface 11*a*. Therefore the photosensitive drum 11 is rotated before the cover 5 covers the opening section 4 of the main body 1 of the apparatus.

When the photosensitive drum 11 has been rotated as described above, the area with the toner stuck on the surface 11*a* between the developing position P11 and the transcribing position P12 is rotated away from the transcribing position P12 where it is in contact with the transfer roller 18, to the downstream side of the transfer position P12, in the rotating direction. The area with toner stuck to the surface 11*a* of the photosensitive drum 11, is thus caused to come into contact with the cleaning blade 21, on the downstream side. The toner, stuck on the surface 11*a* of the photosensitive drum 11, is wiped off by the cleaning blade 21, and is collected in the waste toner tank 22.

When the opening section 4 of the main body 1 of the apparatus has been covered by the cover 5 again, the transfer roller 18 is in contact with the surface of the photosensitive drum 11 at the transcribing position P12. However, there is no toner stuck on the area of the surface 11*a* of the photosensitive drum 11 between the developing position P11 and the transcribing position P12. Therefore, the toner from the photosensitive drum 11 does not stick to the transfer roller 18, even if the photosensitive drum 11 rotates again.

A limitation spring 34 is provided in the main body 1 of the apparatus. The limitation spring 34 is a limiting member, which limits a movable range of the cover 5 to abut the cover 5 with the opening section 4 of the main body 11 of the apparatus when the cover 5 is moved from the second position P2 toward the first position P1. For example, a compression coil spring is provided as the limitation spring 34. The limitation spring 34 is provided, for example, on a step portion 4*a* of an upper edge portion of the opening section 4, matching the direction along the urging force of the limitation spring 34 with the direction along the covering/uncovering of the cover 5. When the cover 5 uncovers the opening section 4, the limitation spring 34, protrudes from the opening section 4 outside of the main body 1 of the apparatus at no-load. When the cover 5 covers the opening section 4, the limitation spring 34 is pushed and compressed by the cover 5 and forced inward to the opening section 4.

When the sensor 32 detects the covering motion of the cover 5, it is supposed that the transfer roller 18 assembled on the cover 5 is in contact with the photosensitive drum 11 because the user rotated the cover 5 rapidly toward the opening section 4 of the main body 1, before the rotation of the photosensitive drum 11 was started. Hence, the limitation spring 34 is provided on the opening section 4. Thus, the cover 5 is limited in its motion as it abuts the limitation spring 34, as it approaches the opening section 4, and it prevents the transfer roller 18 instantly contacting the photosensitive drum 11. The user pushes the cover 5 into the opening section 4 against the spring force of the limitation spring 34. Therefore the time from the detection of the cover 5 by the sensor 32 to the time the transfer roller 18 comes into contact with the photosensitive drum 11 can be extended.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a main body having an opening section;

a cover which is attached to the main body, and which can be moved between a first position where the opening section is covered and a second position where the opening section is uncovered;

a photosensitive member which is provided to be rotated in the main body of the apparatus facing the opening section;

a developer which is provided in the main body of the apparatus to form a toner image by sticking toner on the photosensitive member at a developing position;

a transfer roller which is provided in the main body of the apparatus attached to an inner surface of the cover to face the photosensitive member, and which transcribes the toner image formed on the photosensitive member to recording paper at a transcribing position on a downstream side from the developing position, in a rotating direction of the photosensitive member; and a control mechanism which is provided on the main body of the apparatus to rotate the photosensitive member by a distance larger than a distance between the developing position and the transcribing position when the cover is moved at least one of: (i) from the first position to the second position, and (ii) from the second position to the first position.

2. The image forming apparatus according to claim 1, wherein the control mechanism rotates the photosensitive member when the cover is moved from the first position to the second position.

3. The image forming apparatus according to claim 1, wherein the control mechanism rotates the photosensitive member when the cover is moved from the second position to the first position.

4. The image forming apparatus according to claim 1, wherein the control mechanism comprises a sensor which detects motion of the cover between the first position and the second position.

5. The image forming apparatus according to claim 1, wherein the main body is equipped with a limiting member which limits a movable range of the cover near the opening section when the cover is moved from the second position to the first position.

6. A method of controlling a photosensitive member in an image forming apparatus, said method comprising:

detecting movement of a cover that covers an opening section provided within the image forming apparatus for accessing the photosensitive member; and rotating the photosensitive member by a distance that is equal to or larger than a distance from a developing position where a toner image is formed on a surface of the photosensitive member to a transfer position where the toner image is transferred onto a recording paper by a transfer roller mounted on an inner side of the cover to face the photosensitive member on a downstream side from the developing position along a rotating direction of the photosensitive member.

* * * * *